US006488391B1

(12) United States Patent
Gary et al.

(10) Patent No.: US 6,488,391 B1
(45) Date of Patent: Dec. 3, 2002

(54) DECORATIVE ARTICLE HAVING FOLDABLE MEMBERS

(75) Inventors: Lonnie F. Gary, Ransome Canyon, TX (US); Chad H. Jones, Lubbock, TX (US)

(73) Assignee: Emerald Innovations, L.L.C., Butler, PA (US)

( * ) Notice: Subject to any disclaimer, the term of this patent is extended or adjusted under 35 U.S.C. 154(b) by 0 days.

(21) Appl. No.: 09/722,557

(22) Filed: Nov. 28, 2000

Related U.S. Application Data

(60) Provisional application No. 60/171,893, filed on Dec. 23, 1999.

(51) Int. Cl.[7] ..... F21V 21/00

(52) U.S. Cl. ..... 362/249; 362/18; 362/121; 362/238; 362/250; 362/252; 362/239; 362/450; 362/807; 428/8; 428/9; 428/11; 428/12; 248/150

(58) Field of Search ..... 362/249, 238, 362/252, 250, 121, 806, 807, 450, 128, 239, 352, 18; 40/431; 248/150, 155.4; 428/9, 11, 12, 27

(56) References Cited

U.S. PATENT DOCUMENTS

| | | | | |
|---|---|---|---|---|
| 1,433,273 A | | 10/1922 | Graves | |
| 2,853,598 A | | 9/1958 | Balthauser | |
| 2,894,345 A | | 7/1959 | Bushnell | |
| 3,182,186 A | * | 5/1965 | Faulk | 40/431 |
| 3,184,366 A | | 5/1965 | Claude | |
| 3,374,798 A | | 3/1968 | Samuelson | |
| 3,546,049 A | | 12/1970 | Kostich | |
| 3,704,367 A | | 11/1972 | Korb | |
| 3,977,683 A | | 8/1976 | Tomura | |
| 4,816,316 A | | 3/1989 | Robbins, III | |
| 5,629,057 A | | 5/1997 | Wang et al. | |
| 5,845,451 A | | 12/1998 | Tolentino | |
| 6,273,583 B1 | | 8/2001 | Trisler | |

* cited by examiner

*Primary Examiner*—Stephen Husar
*Assistant Examiner*—Bertrand Zeade
(74) *Attorney, Agent, or Firm*—Calfee, Halter & Griswold, LLP

(57) ABSTRACT

A decorative article includes a plurality of members hingedly connected to one another and movable between a folded storage position and an unfolded display position. Each of the members includes a top surface, a bottom surface, and first and second sides. A hinge interconnects adjacent members between respective first and second sides. Ones of the top surfaces overlay each other and ones of the bottom surfaces overlay each other in the article folded storage position, such that in the article folded storage position, the article has a height equal to the sum of the heights of the members, and in the article unfolded display position, the article has a height equal to the height of one of the members and wherein the members are arranged in a circular pattern.

5 Claims, 9 Drawing Sheets

DECORATIVE ARTICLE HAVING FOLDABLE MEMBERS

RELATED APPLICATION

The present application claims priority to Provisional application Ser. No. 60/171,893 filed Dec. 23, 1999, and entitled "Folding Star and Snowflake".

TECHNICAL FIELD OF THE INVENTION

The present invention relates to decorative articles, and more particularly to a decorative article having foldable members which are hinged together for movement between a folded storage position and an unfolded display position.

BACKGROUND OF THE INVENTION

The use of decorative articles on homes and yards, on commercial establishments, and in other areas is well known. Decorative articles are typically covered with lights for display. The use of lighted decorative articles is common, particularly during holiday seasons. Shapes are utilized for decorative articles, such as for example, star shapes and snowflakes. In order for such articles to be plainly visible, the article must be of a sufficient size to be easily seen from great distances. Storage of decorative articles can be difficult and inefficient in that a space large enough must be provided to store the entire article. Large articles are more costly to ship, and require more display space at point of sale.

Therefore, a need has arisen for a decorative article that can be easily reconfigured to a more compact storage and/or shipping position and that can be easily alternated between a display and a storage position.

SUMMARY OF THE INVENTION

In accordance with the present invention, a decorative article is provided. The decorative article includes a plurality of members hingedly connected to one another and movable between a folded storage position and an unfolded display position. Each of the members includes a top surface, a bottom surface, and first and second sides. The height of the article is defined between the top and bottom surfaces. A hinge interconnects adjacent members between respective first and second sides. Ones of the top surfaces overlay each other and ones of the bottom surfaces overlay each other in the article folded storage position, such that in the article folded storage position, the article has a height equal to the sum of the heights of the members, and in the article unfolded display position, the article has a height equal to the height of one of the members and wherein the members are arranged in a circular pattern.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
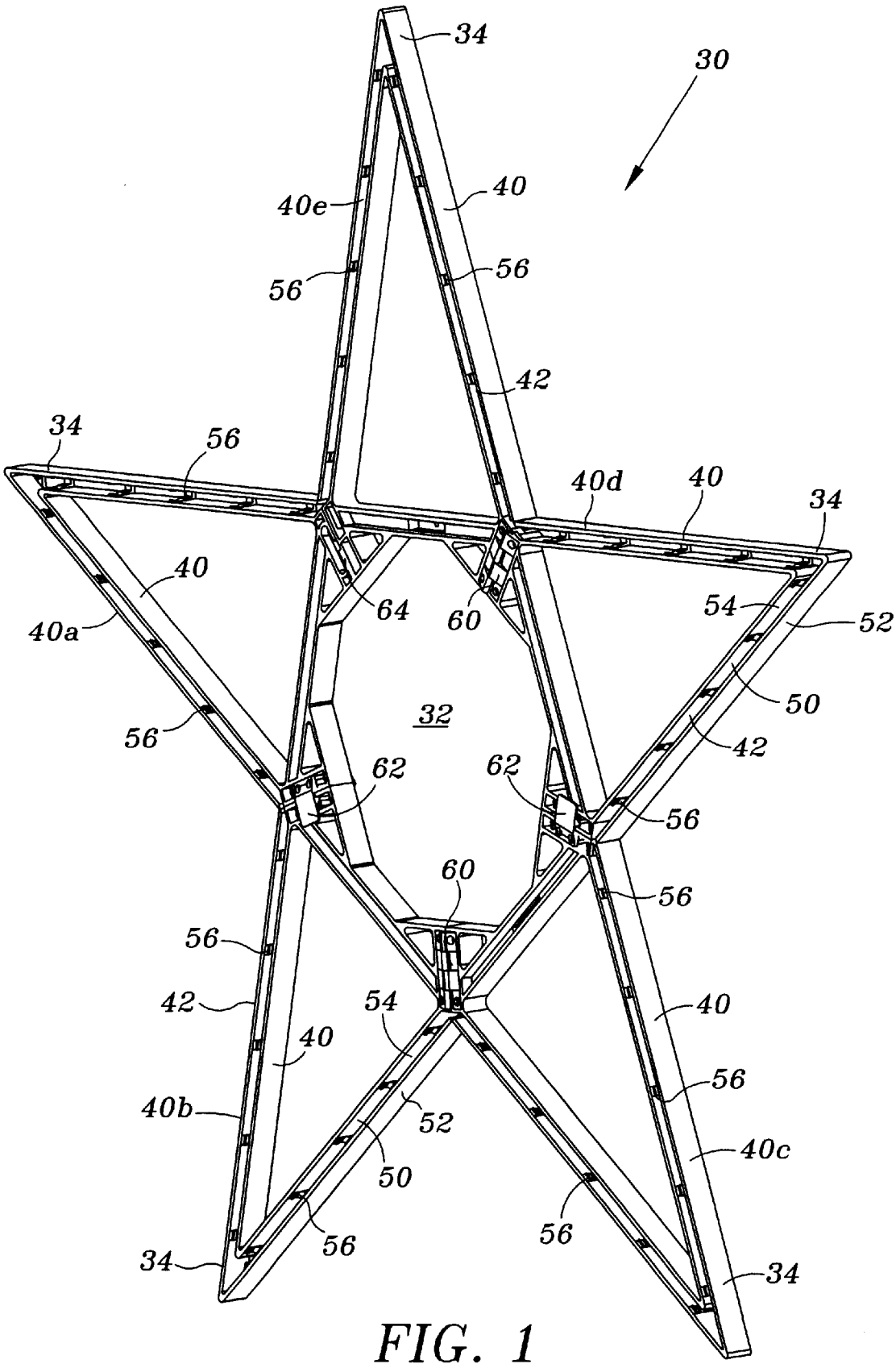
FIG. 1 is a top perspective view of a first embodiment of the present decorative article in the unfolded display position.
Figure 2:
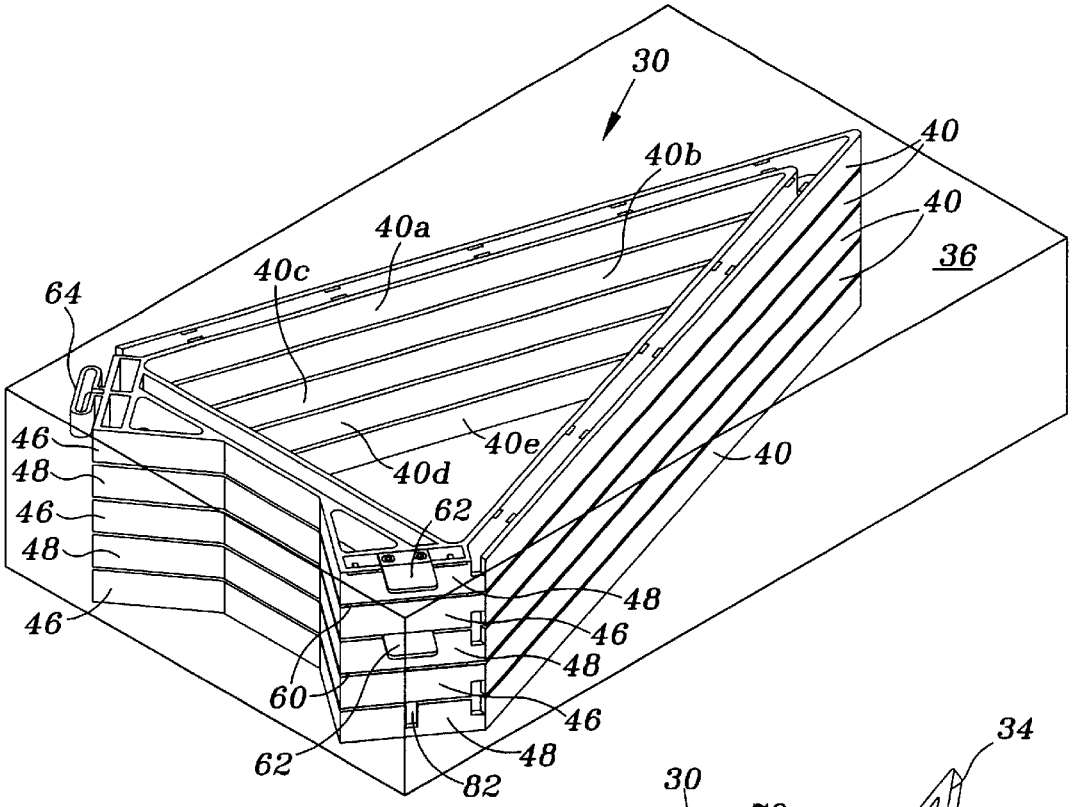
FIG. 2 is a top perspective view of the decorative article of FIG. 1 in the folded storage position.
Figure 13:
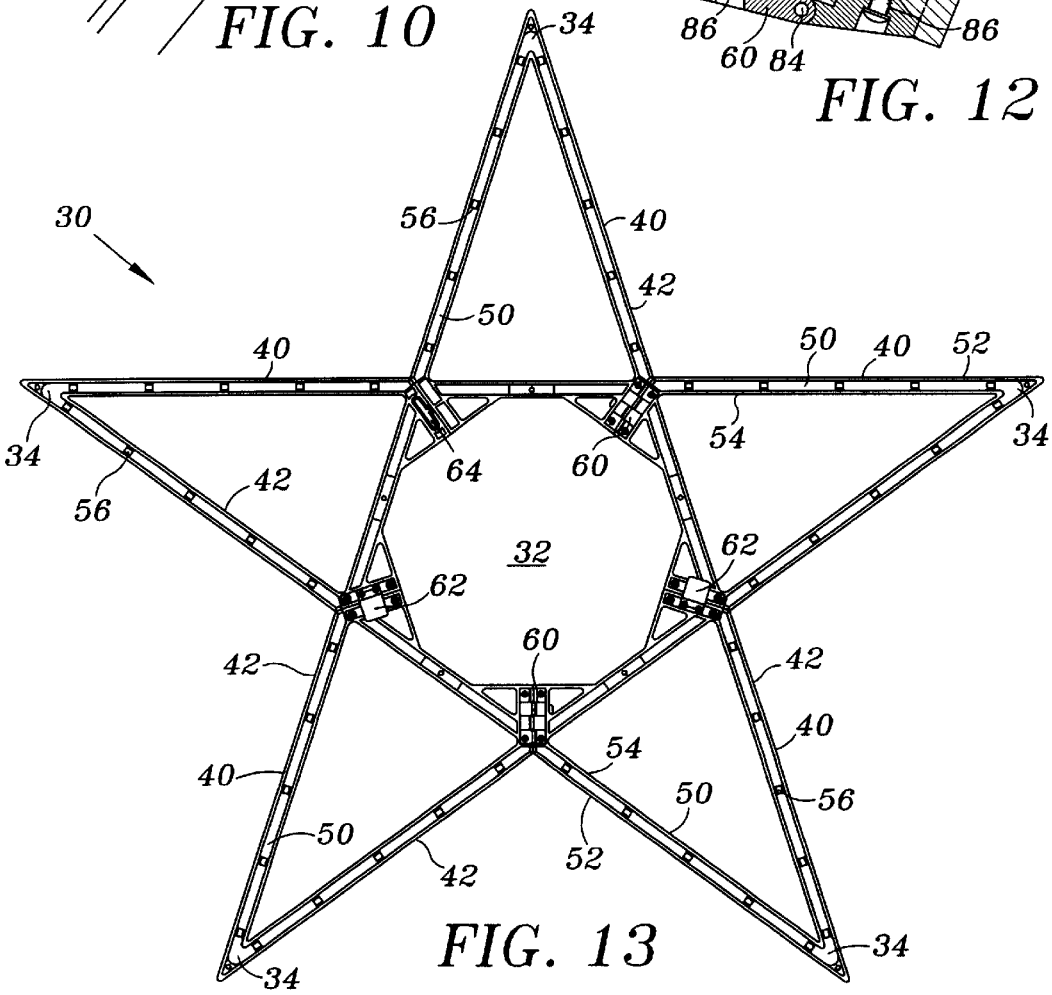
FIG. 13 is a top plan view of the decorative articles of FIG. 1 in the unfolded display position.

Referring simultaneously to FIGS. 1, 2, and 13, a first embodiment of the present decorative article is illustrated, and is generally identified by the numeral 30. Decorative article 30 is in the form of a star 32, having five projections or points 34. FIGS. 1 and 13 illustrates article 30 in an unfolded display position whereas FIG. 2 illustrates article 30 in a folded storage position within a container or box 36. Box 36 is utilized for shipping and storage of decorative article 30 when decorative article 30 is not in use.

Figure 14:
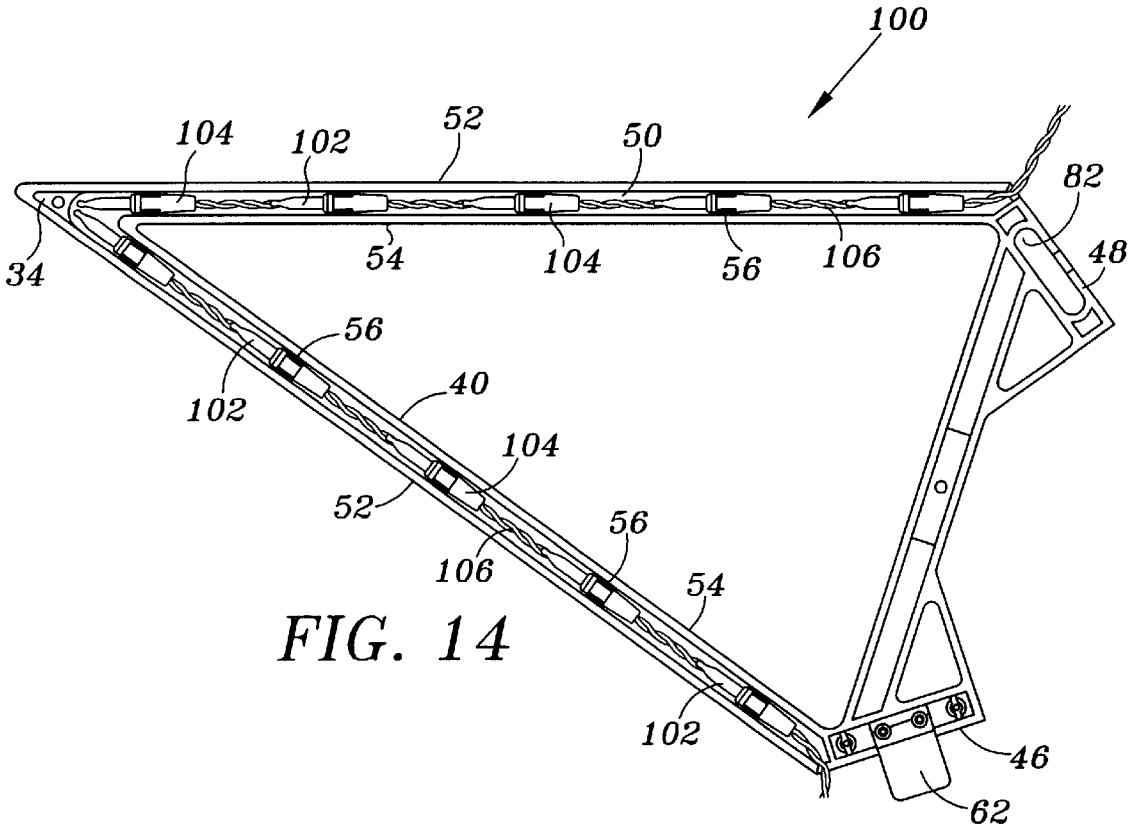
FIG. 14 is a top plan view of one of the members of the decorative article of FIG. 1 including a string of lights.
Figure 15:
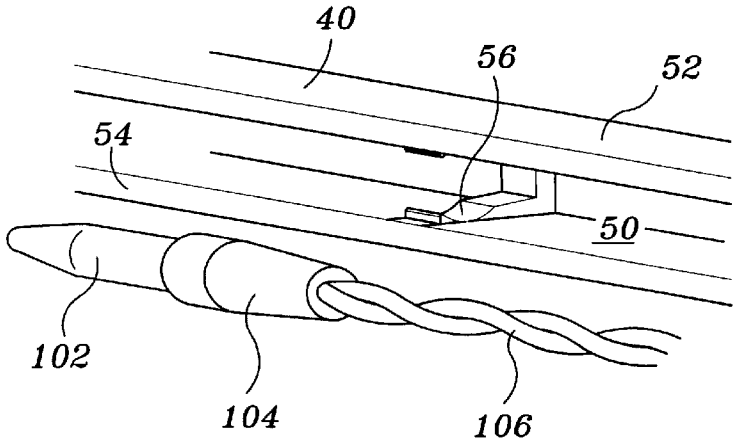
FIG. 15 is an enlarged portion of a track of a member shown in FIG. 14 illustrating a clip for retaining a base of a bulb of a string of lights.

Article 30 includes a plurality of adjacent members 40 which are hingedly and foldably connected to one another to allow article 30 to move from the unfolded display position shown in FIG. 1 to the folded storage position shown in FIG. 2. Each member 40 is configured in the shape of a triangle which forms one of the points 34 of star 32. Article 30 is illustrated with five members 40, 40*a*–40*e*, it being understood that other configurations of article 30 are possible utilizing the present invention, and a star having five points 34 is shown for illustrative purposes only. Each member 40 includes a top surface 42, a bottom surface 44, a first side 46, and a second side 48. Members 40 may be fabricated from a track 50 having spaced apart walls 52 and 54. Track 50 may be utilized for mounting a string of lights between walls 52 and 54 as illustrated in FIGS. 14 and 15 using clips 56.

Members 40 are hingedly interconnected utilizing hinges 60 which are attached to a first side 46 of one member 40 and a second side 48 of an adjoining member 40. Hinges 60 are disposed on alternating top and bottom surfaces 42 and 44 of adjacent members 40*a*–40*e*. Disposed on the opposite side of each hinge 60 is a lock 62 for rigidly locking adjacent members 40 together to form a rigid article 30 when in the unfolded display position. Members 40*a* and 40*e* are releasably interconnected utilizing a connector 64 extending from first side 46 of member 40*a*. Connector 64 mates with a portion of track 50 adjacent second side 48 of member 40*e*. Through use of connector 64 and locks 62, all members 40*a*–40*e* are rigidly connected in the unfolded display position as illustrated in FIG. 1.

Figure 3:
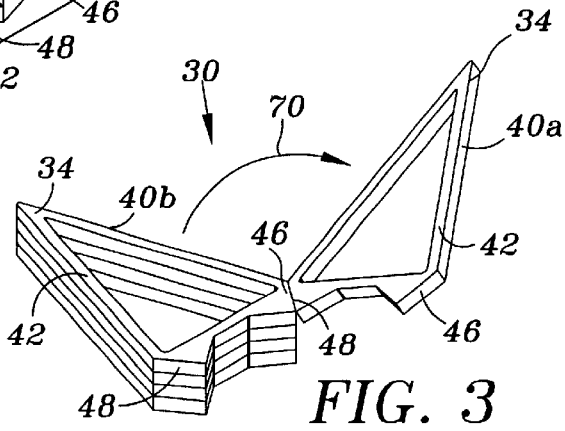
FIGS. 3–7 are top perspective views of the decorative article of FIG. 1 illustrating the sequential unfolding of members from the folded storage position to the unfolded display position.

Referring now to FIGS. 2–7, the steps involved in unfolding article 30 from the folded storage position as illustrated in FIG. 2 to the unfolded display position illustrated in FIG. 1 will now be described. In the folded storage position of article 30, each member 40 is disposed in an overlying position with respect to an adjoining member 40 as illustrated in FIG. 2. The overall height of article 30 in the folded storage position is equal to the sum of the heights of each member 40, where the height of a member 40 is defined as the distance between the top 42 and bottom 44 surfaces of a member 40. As shown in FIG. 3, member 40*a* is rotated in the direction of arrow 70. In the folded storage position of article 30, top surface 42 of member 40*a* lies adjacent to top surface 42 of member 40*b*. Second side 48 of member 40*a* is hingedly interconnected to first side 46 of member 40*b* utilizing a hinge 60 (FIG. 2). A lock 62 (FIG. 2) interconnects bottom surfaces 44 of members 40*a* and 40*b*.

Figure 4:
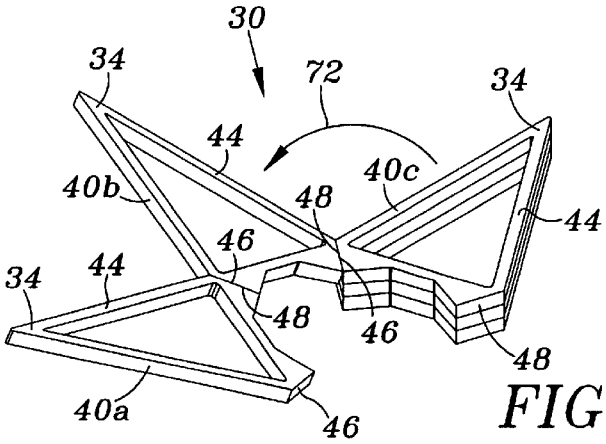

Referring now to FIG. 4, members 40*a* and 40*b* are rotated in the direction of arrow 72 thereby exposing the bottom surface 44 of member 40*c*. Bottom surfaces 44 of member 40*b* and 40*c* lie adjacent one another in the folded storage position of article 30 as illustrated in FIG. 2. Side wall 48 of member 40*b* is hingedly interconnected to side wall 46 of member 40*c* by a hinge 60 which is disposed on bottom surfaces 44 of members 40*b* and 40*c*. A lock 62 is disposed below hinge 60 on the top surfaces 42 of members 40*b* and 40*c* in order to lock members 40*b* and 40*c* together in the unfolded display position.

Figure 5:
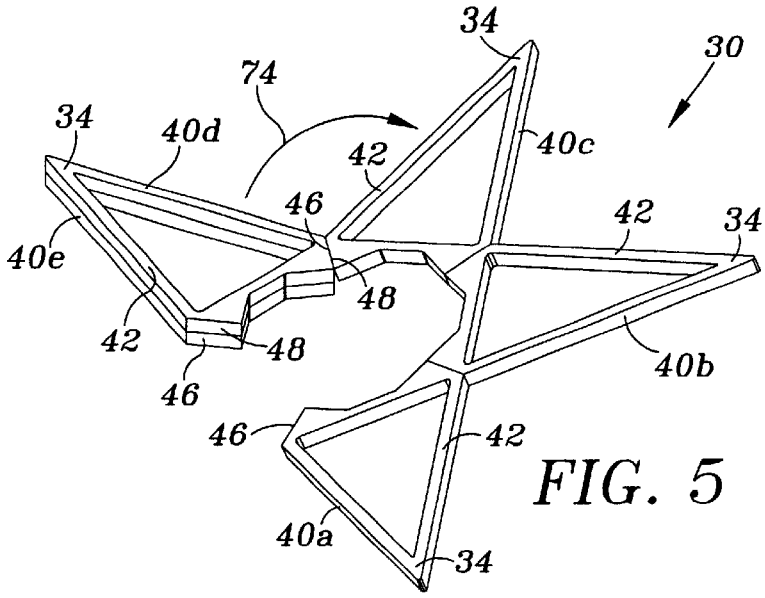

Continuing with FIG. 5, members 40*a*, 40*b*, and 40*c* are rotated in the direction of arrow 74 thereby exposing the top surface 42 of member 40*d*. The top surfaces of members 40*c* and 40*d* lie adjacent one another in the folded storage position of article 30. Second side 48 of member 40*c* is hingedly interconnected to first side 46 of member 40*d* utilizing a hinge 60 (FIG. 2). A lock 62 is disposed on bottom surfaces 44 of members 40*c* and 40*d*.

Figure 6:
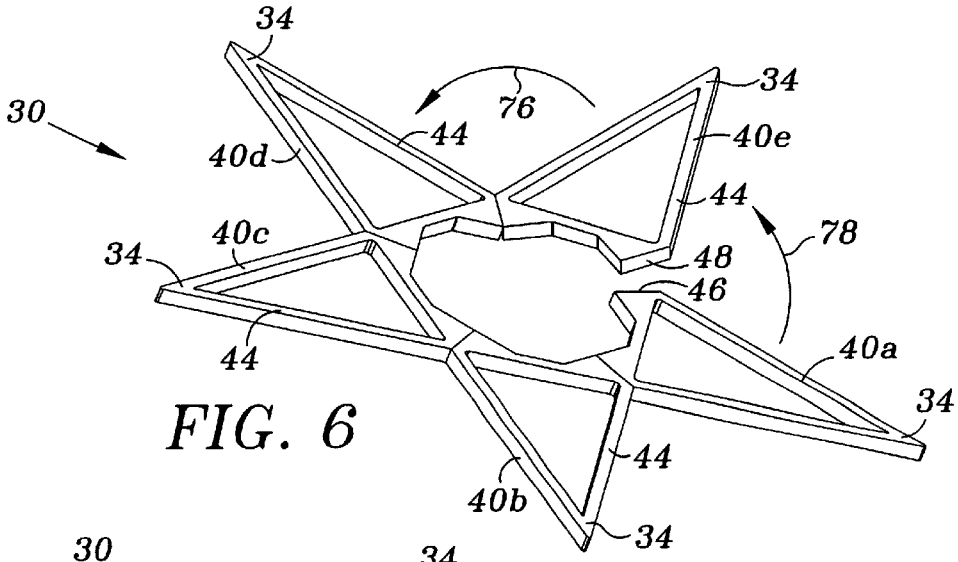

FIG. 6 illustrates decorative article 30 in the completely unfolded display position wherein members 40*a*, 40*b*, 40*c*, and 40*d* are rotated in the direction of arrow 76 to expose the bottom surface of member 40*e*. Bottom surfaces 44 of members 40*d* and 40*e* are disposed adjacent to one another in the folded storage position of article 30. Second side 48 of member 40*d* is hingedly interconnected to first side 46 of member 40*e* utilizing a hinge 60, which is disposed on the bottom surface 44 of members 40*d* and 40*e*. Member 40*a* is moved in the direction of arrow 78 to interconnect member 40*a* to member 40*e* utilizing connector 64.

Figure 7:
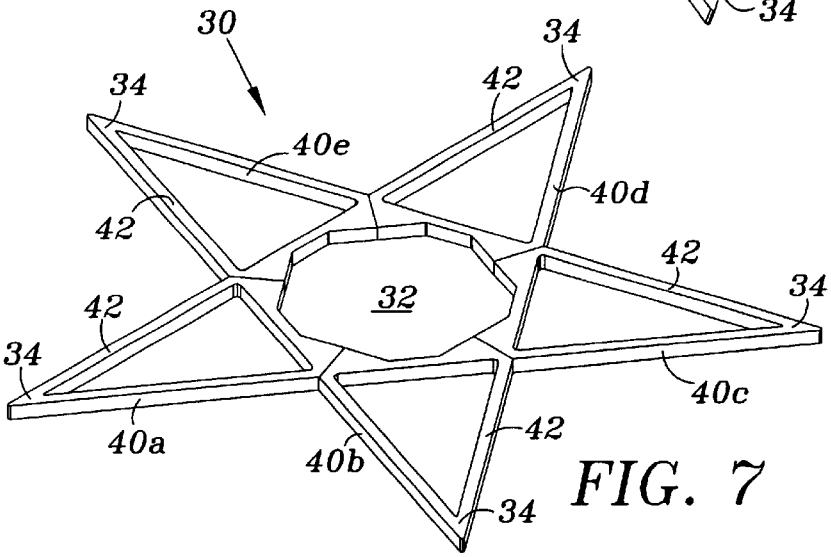

FIG. 7 illustrates article 30 with the top surface 42 in the upward position. The height of article 30 in the unfolded display position illustrated in FIGS. 1, 7, and 13 is the height of one member 40. In viewing the configuration of adjoining members 40, it may be seen that members 40 are arranged in a circular configuration or pattern about the center of star 32 to form a substantial 360° figure. Opposite top and bottom surfaces 42 and 44 of adjoining members 40 are disposed adjacent to one another in the folded storage position illustrated in FIG. 2, such that members 40 unfold in a fan-like alternating manner from the folded storage position illustrated in FIG. 2 to the unfolded display position illustrated in FIGS. 1, 7, and 13.

Figure 8:
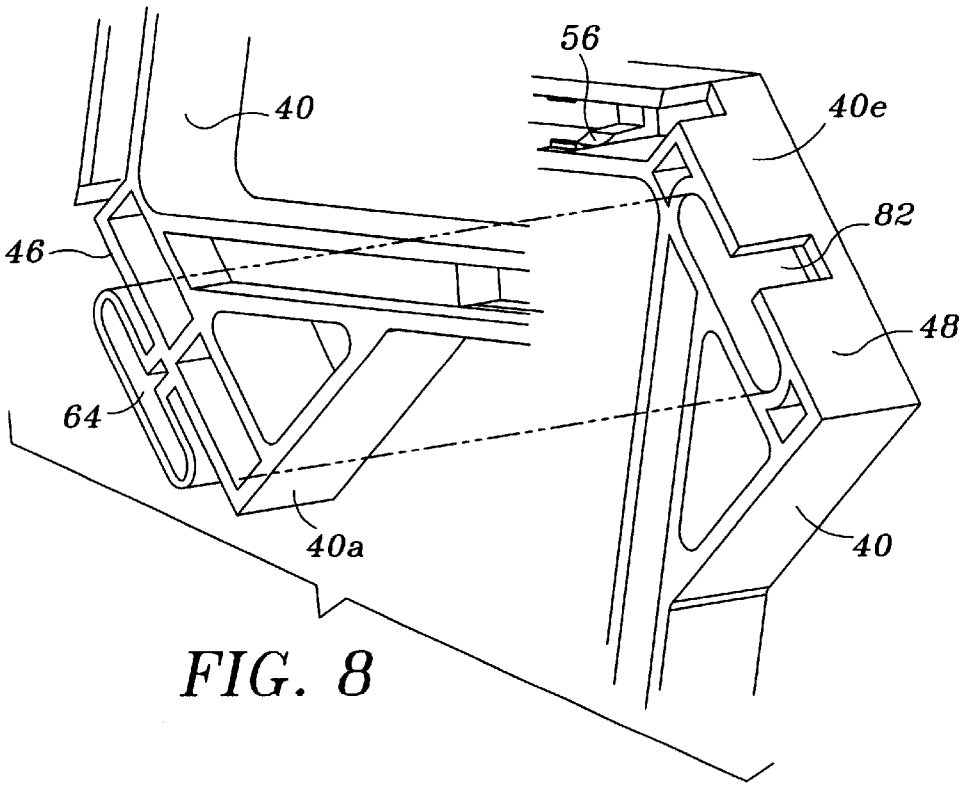
FIG. 8 is an enlarged perspective view of a separable connection between adjacent members of the decorative article of FIG. 1.

FIG. 8 illustrates a releasable connection formed between member 40*a* and member 40*e* through connector 64. Connector 64 mates with a slot 82 within track 50 of second side 48 of member 40*e*.

Figure 9:
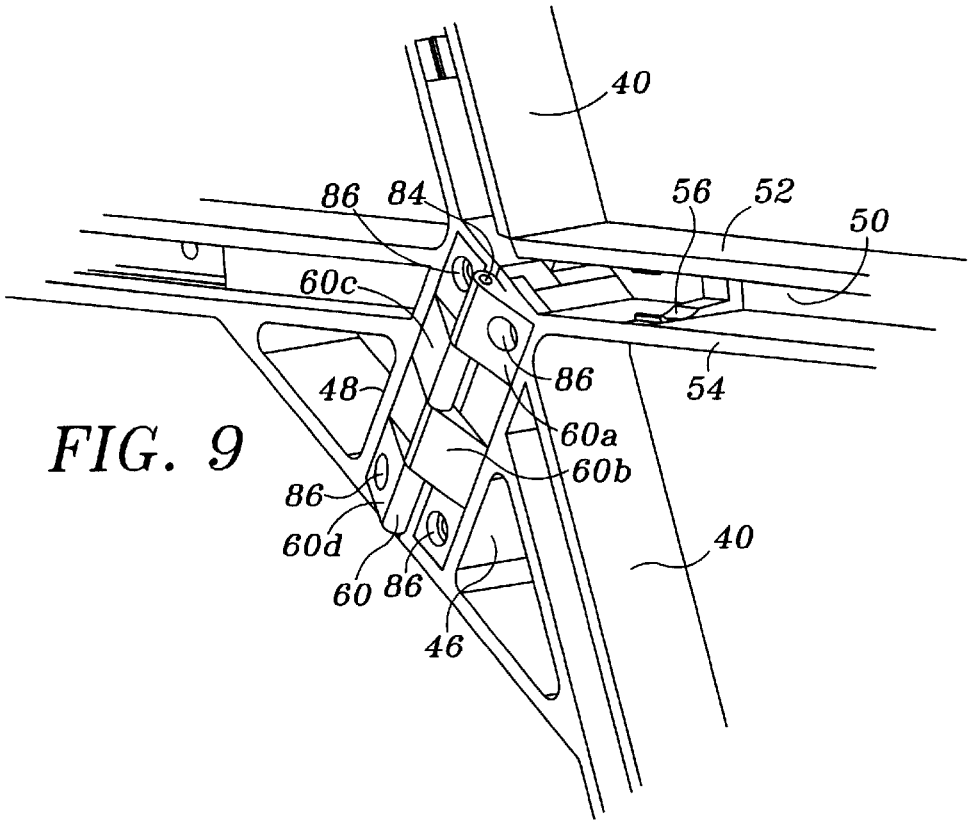
FIG. 9 is an enlarged perspective view of a hinge between adjacent members of the decorative article of FIG. 1.

FIG. 9 illustrates a hinge 60 between adjacent members 40 interconnecting a first side 46 to a second side 48 of a respective member 40. Hinge 60 includes a interconnected fingers 60*a*, 60*b*, 60*c*, and 60*d* which are interconnected by a pin 84. As more clearly illustrated in FIGS. 11 and 12, hinge 60 is interconnected to track 50 utilizing fasteners such as, for example, screws 86.

Figure 10:
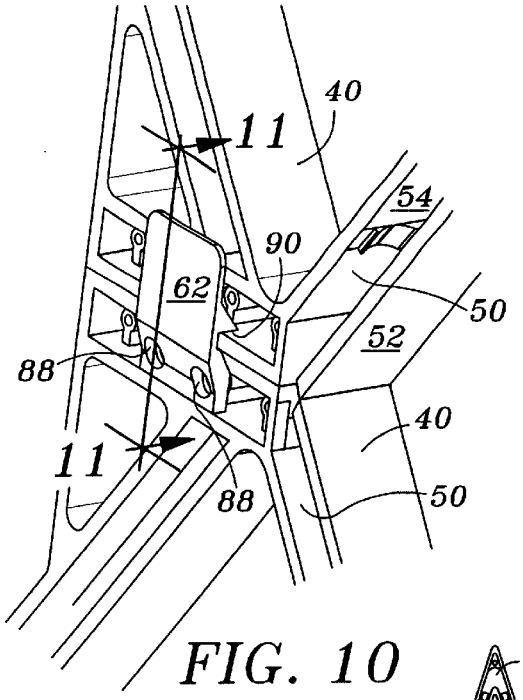
FIG. 10 is an enlarged perspective view of a lock between adjacent members of the decorative article of FIG. 1.
Figure 11:
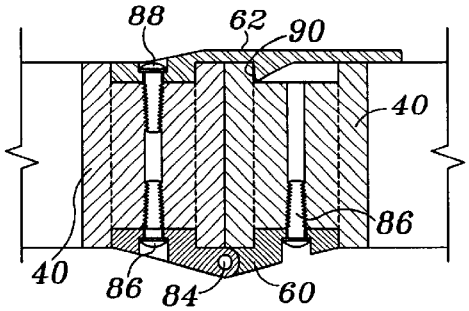
FIG. 11 is a sectional view taken generally along sectional lines 11—11 of FIG. 10 illustrating the lock in a closed position
Figure 12:
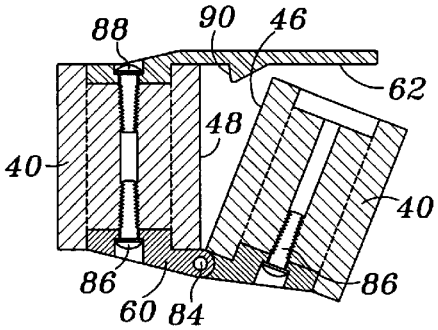
FIG. 12 is a sectional view similar to FIG. 11 illustrating the lock of FIG. 10 in an open position.

Referring simultaneously to FIGS. 10, 11, and 12, a lock 62 is illustrated for interconnecting adjacent members 40 between respective side walls 46 and 48. Lock 62 is interconnected to track 50 utilizing fasteners such as, for example, screws 88. Lock 62 includes a catch 90 which engages a side wall 46 or 48 for rigidly connecting adjacent members 40 in the unfolded display position of article 30.

Referring now to FIGS. 14 and 15, article 30 may include a plurality of lights 100 disposed within track 50. Lights 100 may generally comprise a light string of a type known in the art which includes bulbs 102 and bases 104 connected by interconnecting wires 106. Base 104 is received within a clip 56 disposed within track 50 between walls 52 and 54.

Figure 16:
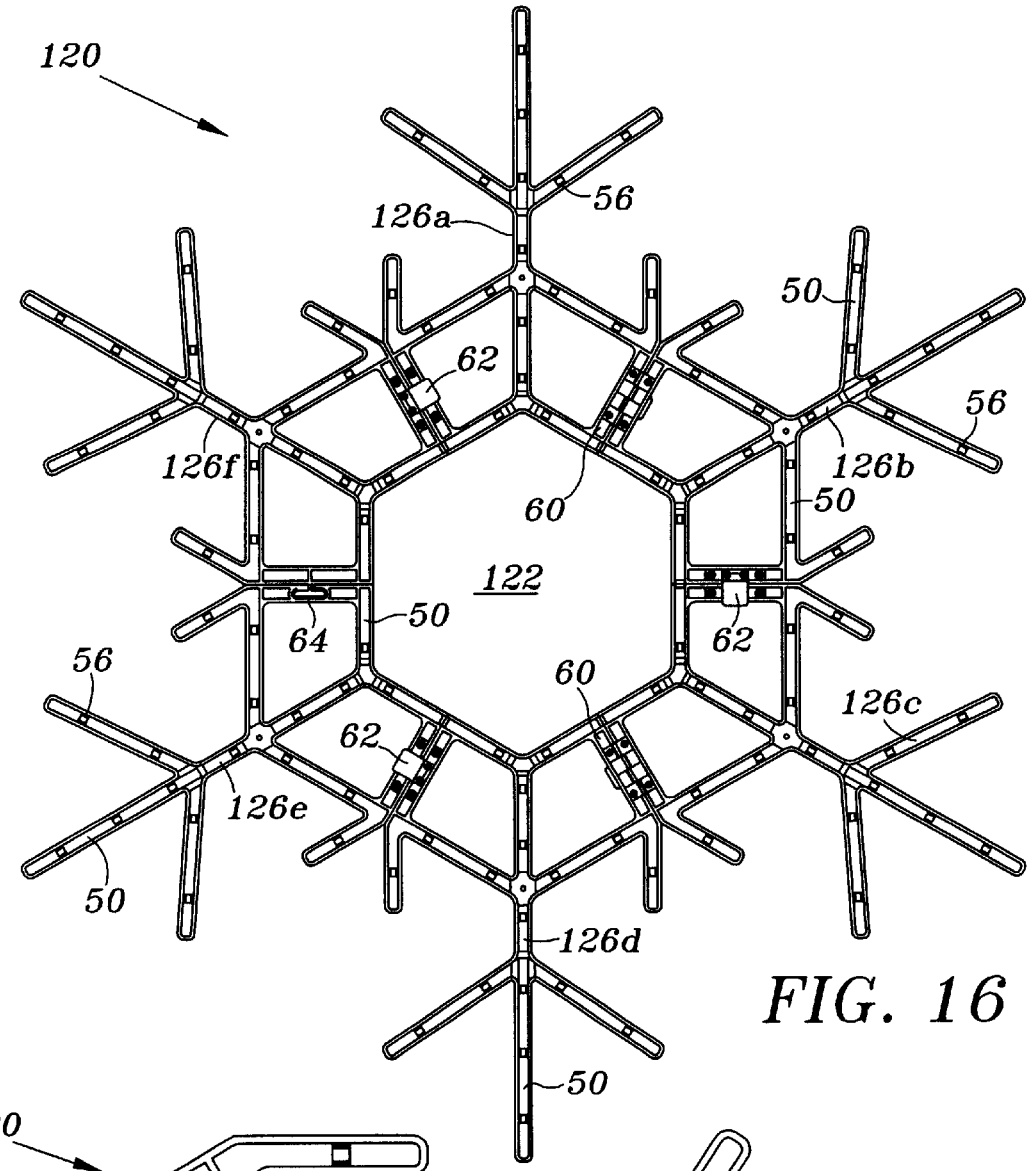
FIG. 16 is a top plan view of an additional embodiment of the present decorative article in the unfolded display position.
Figure 17:
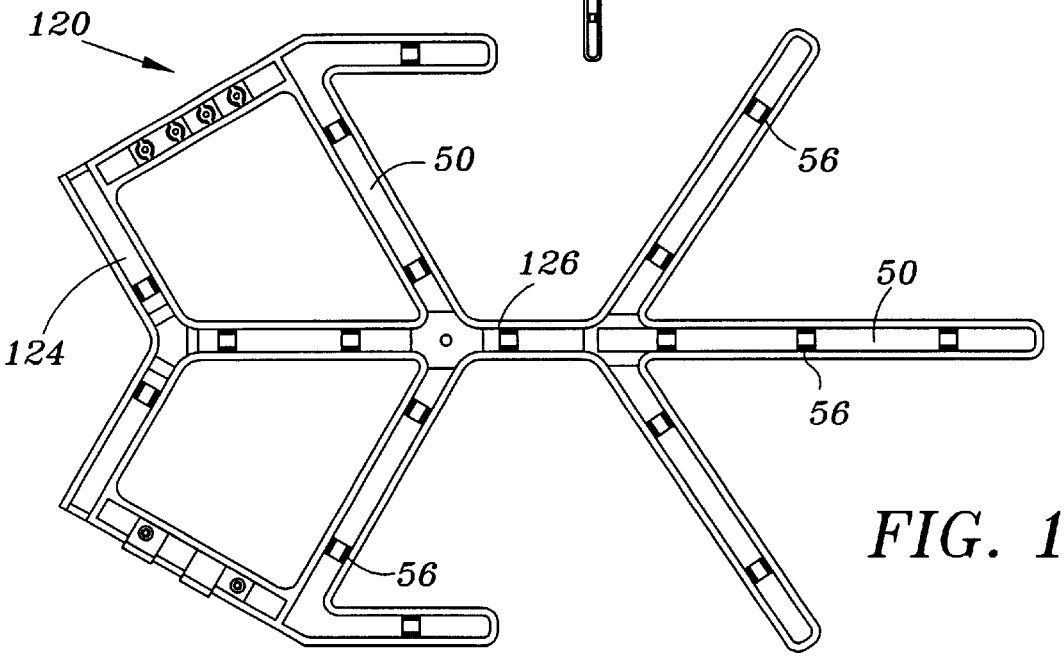
FIG. 17 is a top plan view of one member of the decorative article of FIG. 16.
Figure 18:
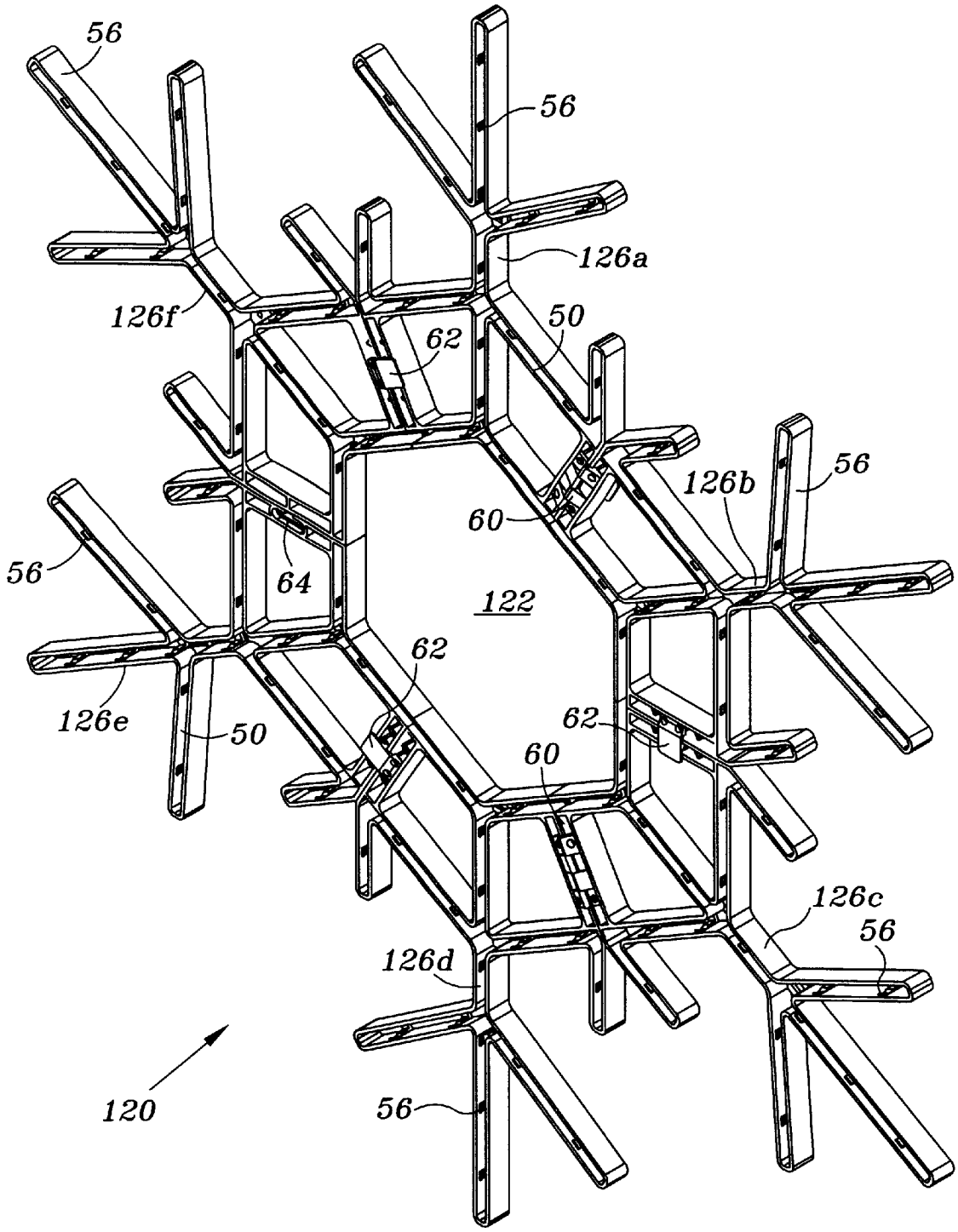
FIG. 18 is a top perspective view of the decorative article of FIG. 16.

Referring now simultaneously to FIGS. 16, 17, and 18, an additional embodiment of the present decorative article is illustrated, and is generally identified by the numeral 120. Like numerals are utilized for like and corresponding components previously identified with respect to article 30. Decorative article 120 is in the form of a snowflake 122. Snowflake 122 includes six branches 124, wherein each branch includes a member 126. Adjacent members 126*a*–*f* are hingedly interconnected in a manner similar to members 40*a*–40*e* of decorative article 30, such that decorative article 120 has a folded storage position similar to that of decorative article 30 as illustrated in FIG. 2.

Figure 19:
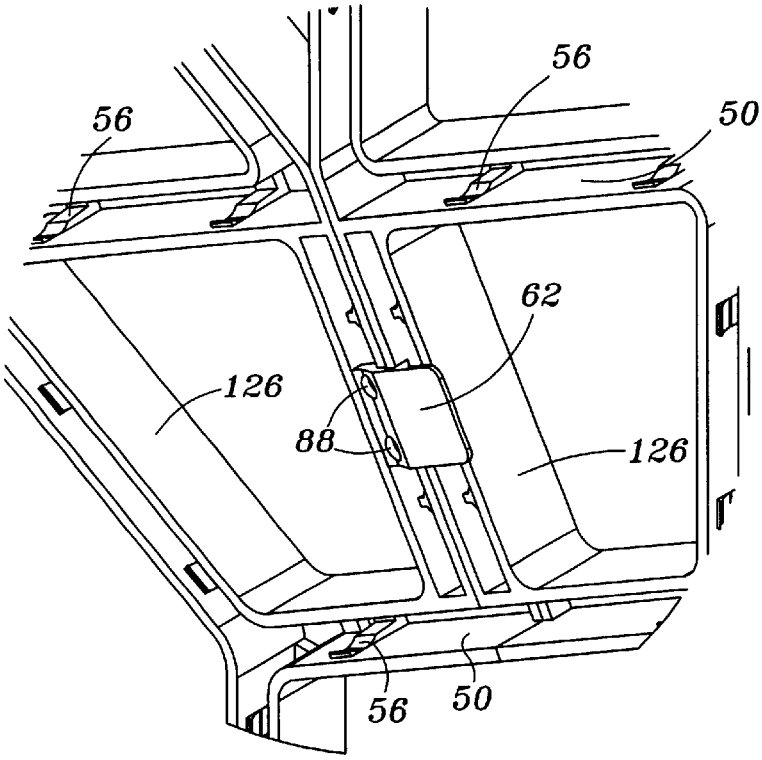
FIG. 19 is an enlarged perspective view of a lock between adjacent members of the decorative article of FIG. 16.
Figure 20:
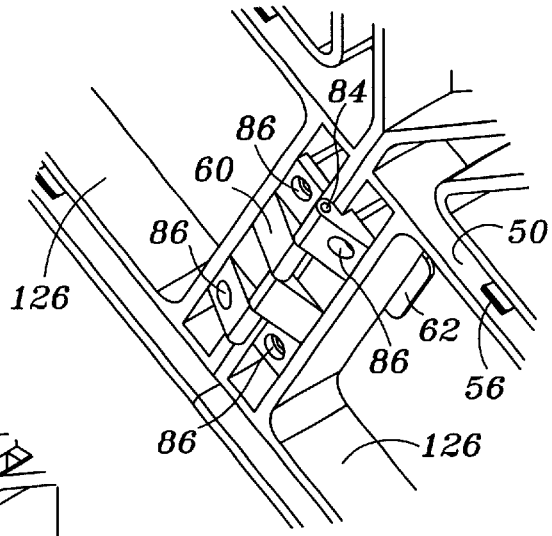
FIG. 20 is an enlarged perspective view of a hinge between adjacent members of the decorative article of FIG. 16.
Figure 21:
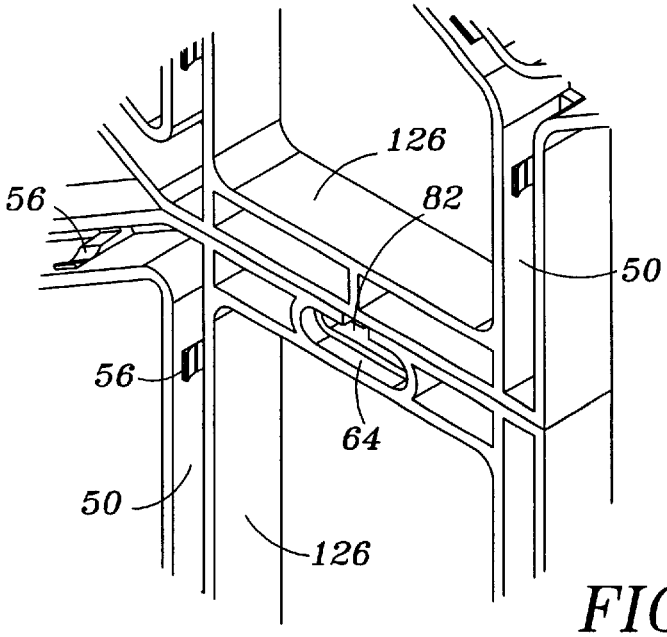
FIG. 21 is an enlarged perspective view of a separable connection between adjacent members of the decorative article of FIG. 16.

FIG. 19 illustrates the use of a lock 62 for rigidly interconnecting adjacent members 126 of decorative article 120. FIG. 20 illustrates a hinge 60 for hingedly interconnecting adjacent members 126. FIG. 21 illustrates releasable connection formed by a connector 64 and slot 82 of adjoining members 126. Members 126 also include clips 56 for receiving a base 104 of lights 100.

Decorative article 120 operates in a manner similar to decorative article 30 wherein members 126 unfold into a 360° configuration about the center of snowflake 122 and wherein opposite top and bottom surfaces lie adjacent to one another in the folded storage position.

Although two decorative articles 30 and 120 have been illustrated, the present invention is not limited to a star or snowflake as illustrated. Additional embodiments such as, for example, a spider web pattern may also be utilized in which a plurality of hingedly joined members configurable in a 360° pattern in an unfolded display position can be utilized.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A decorative article comprising:

a plurality of members hingedly connected to one another and movable between a folded storage position and an unfolded display position;

each of said members having a top surface, a bottom surface, and first and second sides, each member further having a height extending between said top and bottom surfaces;

a hinge interconnecting adjacent members between respective first and second sides; and ones of said top surfaces overlaying each other and ones of said bottom surfaces overlaying each other in said article folded position, such that in said article folded storage position the article has a height equal to the sum of said heights of said members and in said display position, the article has a height equal to said height of one of said members, said plurality of hingedly connected members being arranged in a circular pattern in said unfolded display position.

2. The decorative article of claim 1 wherein said members include a track.

3. The decorative article of claim 1 wherein said members include a triangular configuration.

4. The decorative article of claim 1 wherein said members include a snowflake configuration.

5. The decorative article of claim 1 and further including a plurality of lights attached to said members.

* * * * *